US005107790A

United States Patent [19]

Sliker et al.

[11] Patent Number: 5,107,790

[45] Date of Patent: Apr. 28, 1992

[54] TWO HEADED COATER

[75] Inventors: Larry J. Sliker, Livonia; Robert S. Conklin, Rochester, both of N.Y.

[73] Assignee: Rapidac Machine Corp., Rochester, N.Y.

[21] Appl. No.: 463,115

[22] Filed: Jan. 11, 1990

[51] Int. Cl.[5] ..... B05C 1/08; B05C 11/00

[52] U.S. Cl. ..... 118/674; 118/46; 118/212; 118/249; 118/255; 118/258; 118/262

[58] Field of Search ..... 118/674, 46, 249, 255, 118/258, 262, DIG. 1; 101/247, 329, 352

[56] References Cited

U.S. PATENT DOCUMENTS

| | | | |
|---|---|---|---|
| 3,931,791 | 1/1976 | Preuss | 118/249 |
| 4,270,483 | 6/1981 | Butler et al. | 118/258 |
| 4,397,237 | 8/1983 | Makosch | 118/262 X |
| 4,399,767 | 8/1983 | Simeth | 118/236 |
| 4,421,027 | 12/1983 | Fischer | 101/142 |
| 4,446,814 | 5/1984 | Abendroth et al. | 118/46 |
| 4,569,306 | 2/1986 | Ito et al. | 118/46 |
| 4,615,293 | 10/1986 | Jahn | 118/46 |
| 4,685,414 | 8/1987 | Di Rico | 118/262 X |
| 4,796,556 | 1/1989 | Bird | 118/46 |
| 4,806,183 | 2/1989 | Williams | 118/674 |
| 4,825,804 | 5/1989 | Dirico et al. | 118/46 |

*Primary Examiner*—Michael G. Wityshyn
*Attorney, Agent, or Firm*—Cumpston & Shaw

[57] ABSTRACT

Coating apparatus for applying continuous or spot coatings to an image printed surface includes a plate cylinder; a blanket cylinder for transferring a coating material from the plate cylinder to the copies; a blanket coating roller for transferring a continuous layer of coating material to the blanket cylinder; a plate coating roller for selectively applying spot coating material to the plate cylinder; a first retractor for moving the blanket coating roller laterally into and out of transferring engagement with the blanket cylinder; and a second retractor for moving the plate coating roller into and out of transferring engagement with the plate cylinder.

14 Claims, 3 Drawing Sheets

TWO HEADED COATER

This invention relates in general to coating apparatus for printing presses, and more particularly to a dual headed coater adapted to provide overall or spot coating on a printed sheet or web as a final or near final step in the printing process.

The advantages of coating printed sheets are well known, and much effort has been expended in providing satisfactory apparatus for carrying out the coating process. Among the many patents relating to coating apparatus are U.S. Pat. Nos. 4,615,293, 4,569,306, 4,685,414, 4,446,814, 4,421,027, 4,399,767, 4,397,237, 4,308,796, 4,270,483, and 3,931,791.

For flexibility and to reduce costs, printing presses are often assembled from a plurality of substantially identical printing units, the number of units used being determined by the number of colors to be printed. Each printing unit applies a different color ink to the sheet or web to form the printed image. It is advantageous, to reduce costs, and maintain flexibility in adapting the press to different jobs, to provide coating apparatus that may be selectively engaged with the plate or blanket cylinders of an existing printing unit to carry out the coating operation and disengaged so that the printing unit can be used for its normal purpose or allowed to idle when coating is not required.

Among the patents mentioned above, Jahn U.S. Pat. No. 4,615,293 shows a medium applicator for a printing machine. The medium applicator (coater) is disposed downstream of the printing units of the machine, and includes two applicator rollers, one contacting the roller that would function as the plate roller in a conventional printing unit and the other contacting the blanket cylinder. The coating rollers are disposed on the upstream side of the plate and blanket cylinders respectively of the coating assembly.

Although the coating apparatus described in the Jahn patent is theoretically capable of carrying out the spot and blanket coating operations as described, in practice, the arrangement shown in the Jahn patent is impractical, and would be of little use in a large scale printing application.

Printers can produce high volumes of printed material rapidly through the use of modern printing presses. The presses are extremely expensive, and the amount of time required to reconfigure the press from one job to another is non-productive, and costly. Accordingly, there is a need for presses and associated coating apparatus that minimize the time required to clean up from one run, and set up and commence the next run. Although versatile coaters that can apply spot and blanket coatings are desirable, ordinarily only one coater at a time is actually in operation. Where consecutive jobs require the same sort of coating, particularly blanket coating, it may not be necessary to clean up the coater between jobs. However, the coating lacquers cannot be allowed to dry on the rollers, and therefore, especially when switching from blanket to spot coating or vice-versa, or if there is a wait between jobs, it is necessary to clean up the coaters after each job is completed. In addition, cleanup is necessary when switching between different coating compositions, such as aqueous and u-v coatings. Such coatings are incompatible, and the coaters must be cleaned between applications of such different coatings.

Modern high speed printing presses are dangerous to work around in ordinary circumstances, and are particularly dangerous when operating at full speed. It would be virtually impossible to clean the prior art coaters such as the coater shown in the Jahn patent while the press is operating, and especially difficult for example to clean the blanket coater while printing spot coatings on a subsequent job.

Accordingly, it is an object of this invention to provide coating apparatus for applying continuous or spot coatings to an image printed surface comprising: a plate cylinder; a blanket cylinder for transferring a coating material from the plate cylinder to the copies; a blanket coating roller for transferring a continuous layer of coating material to the blanket cylinder; a plate coating roller for selectively applying spot coating material to the plate cylinder; first retracting means for moving the blanket coating roller laterally into and out of transferring engagement with the blanket cylinder; and second retracting means for moving the plate coating roller into and out of transferring engagement with the plate cylinder.

It is another object of this invention to provide coating apparatus of the type described and further including tachometer or other means responsive to the rotation of the plate and blanket cylinders for providing speed signals proportional to the press speed and control means responsive to the speed signals for controlling the speed of the plate and blanket coating rollers.

It is another object of this invention to provide drive means for the plate and blanket coating rollers, and independent controllers for each of the drive means permitting the relative speeds of the plate and blanket coating rollers and plate and blanket cylinders respectively, to be continuously controlled to adjust the shear at the nip between the rollers and the cylinders at various press speeds for enhancing the coating operation.

It is still another object of this invention to provide a retracting assembly for moving one of the plate and blanket coating rollers horizontally into and out of engagement with one of the plate and blanket cylinders, and for lifting the coating roller assembly away from the cylinder for easy access during cleaning.

It is still another object of this invention to provide means for translating the other coating roller into and out of engagement with the other cylinder, the out of engagement position adapted to permit cleaning of the roller and associated apparatus.

It is a still further object of this invention to provide control means responsive to sensing tachometers or other means providing signals proportioned to press speed coupled to the plate and blanket cylinders for controlling the rotation of the coating rollers and associated pick up and metering rollers for controlling the amount of coating material applied to the printed page.

It is a still further object of this invention to provide control means for incrementally adjusting the relative speed of the pickup, metering, and coating rollers relative to the speed of the plate and blanket cylinders.

It is a feature of this invention that coating rollers can be employed, because of the placement thereof on opposite sides of the press unit, that are larger in diameter than those utilized in prior art coaters. The use of large diameter coating rollers reduces the speed of rotation of the rollers, and thereby the tendency of the rollers to sling coating material off the surface by centrifugal force. This is especially advantageous in pattern or spotting coating operations, where the surface speeds of the applicator roller and plate cylinder must be the same. The use of larger rollers reduces the centrifugal force produced at the surface of the applicator roller, thus greatly reducing the slinging or misting of coating material, when the present invention is employed. Slinging or misting of coating material greatly increases the difficulty of cleanup after a coating operation.

While the novel aspects of the invention are set forth with particularity in the appended claims, the invention itself, together with further objects and advantages thereof, may be more readily understood by reference to the following detailed description of the invention, taken in conjunction with the accompanying drawings.

BRIEF DESCRIPTION OF THE DRAWING

Referring now to FIG. 1, a simplified view of a printing unit, preferably the last unit, of a multi-stage offset printing press is illustrated with the coating apparatus of the invention operatively associated therewith. The coating apparatus of this invention is specially adapted to allow it to be retrofitted to a variety of printing units, either during manufacture, or after a press has been installed in a print shop. The damping and inking systems employed in a conventional printing unit are not shown. They may be omitted if the coating unit is designed solely for coating, removed, or simply disengaged or not used in a printing unit retrofitted for coating in accordance with this invention. The unique construction of the two headed coater of this invention permits the coating rollers to be moved into contact with the plate cylinder and blanket cylinder of the converted printing unit, and to be withdrawn to accessible positions for cleaning when not in use.

Figure 1:
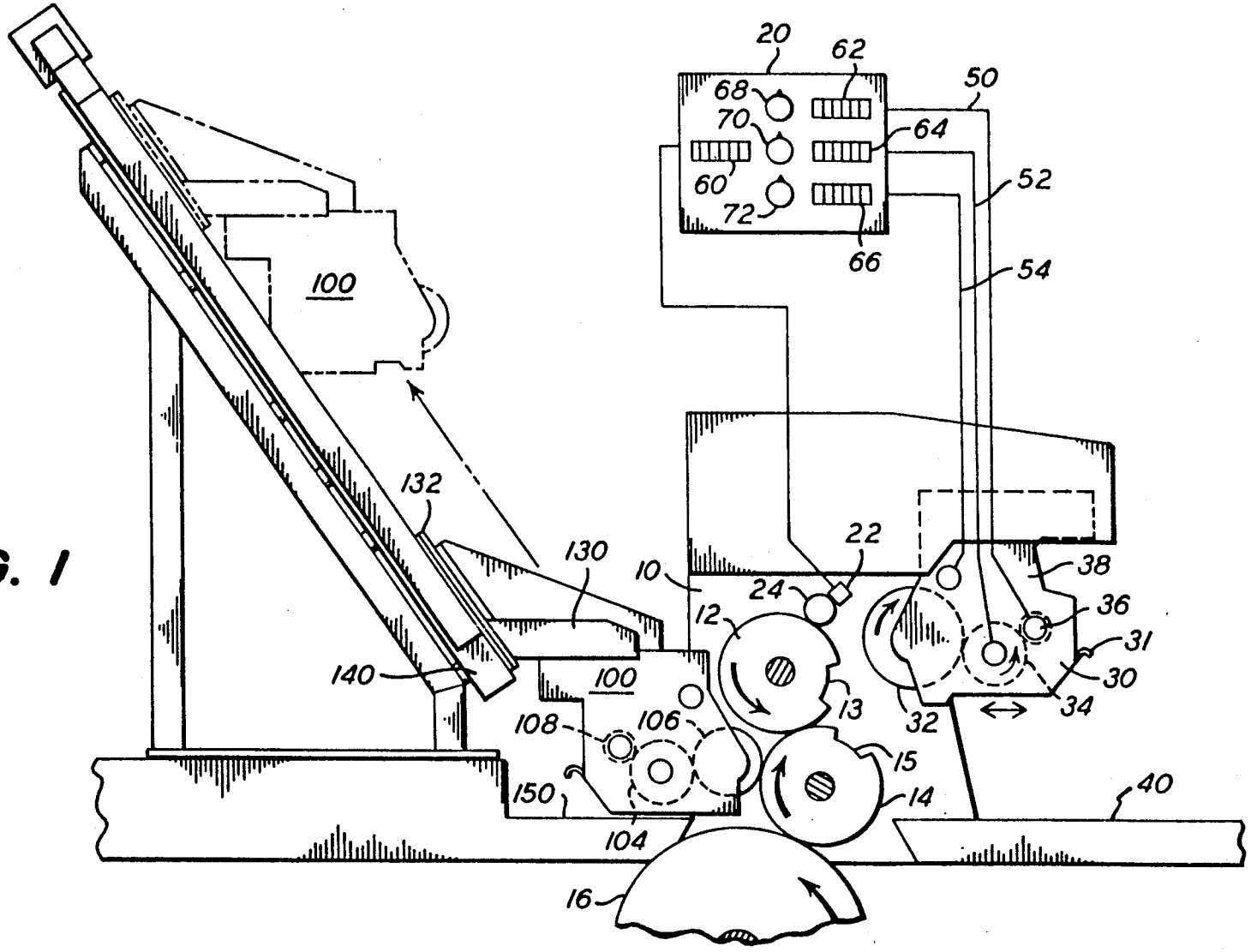
FIG. 1 is a side elevation of a two headed coater in accordance with this invention.

Printing unit 10 includes a plate cylinder 12 and a counter rotating blanket cylinder 14. As used herein, plate and blanket cylinder refer to the assemblies including plates and blankets, and associated clamps and the like, that are disposed in recesses 13 and 15 shown schematically in the drawing for simplicity. Blanket cylinder 14 contacts an impression cylinder 16 under some pressure and the printed sheet is normally passed through the nip between the blanket and the impression cylinders in a manner well understood by those skilled in the art. Conventional drive means, including cylinder gear wheels, a main driver motor and associated controls, not shown, synchronize the rotation of the plate cylinder, blanket cylinder, and impression cylinder, with the rest of the press.

A controller 20 continuously monitors the press speed through the use of a speed sensor, such as tachometer 22, which may be an optical encoder having a wheel 24 arranged to bear against the plate cylinder (or the blanket cylinder if it is more accessible) for providing a continuous speed signal to controller 20. As used herein, the term tachometer is intended to encompass any device that provides a signal from which the relative speed of the press may be determined. Many presses incorporate such devices internally, and the outputs from internal tachometers of whatever sort are often suitable as speed signals for the coaters of the present invention.

Turning now to the spot coater assembly of the invention, the assembly 30 includes a coating roller 32, a pick up roller 34, and a metering roller 36, all journalled in a conventional fashion in a laterally translatable frame 38 as will be more fully described in connection with FIG. 2.

Figure 2:
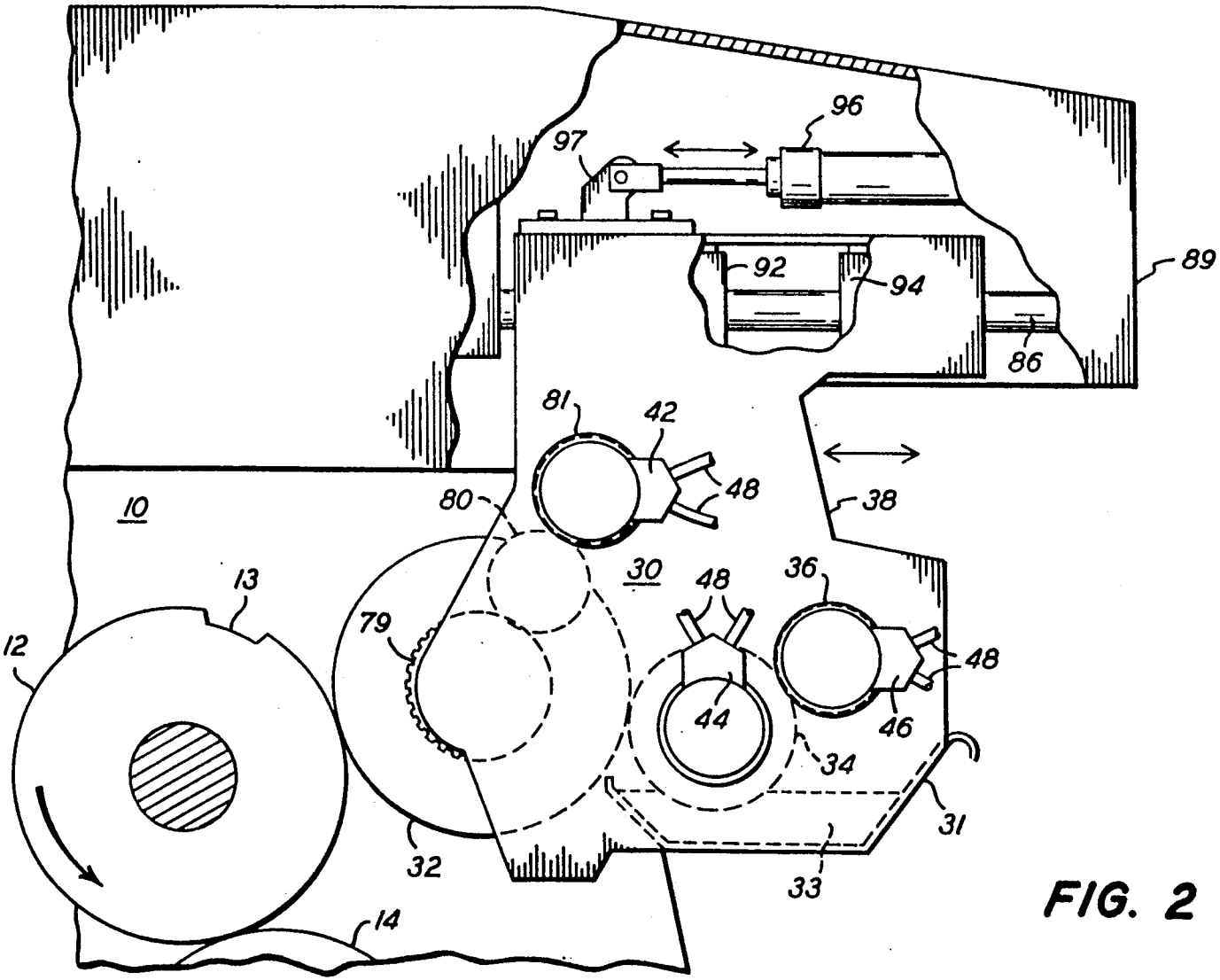
FIG. 2 is an enlarged segmental side elevation of the plate coating assembly of the two headed coater of FIG. 1.

Referring to FIG. 2, pickup roller 34 is adapted to be at least partially immersed in a container 31 of coating material, such as lacquer 33. The container is omitted from FIG. 1 of the drawing, so as not to obscure the remaining elements. Pick up roller 34 rotates counter clockwise, and metering roller 36, by virtue of the spacing at the nip and the relative speed thereof with respect to the pickup roller, controls the amount of coating material transferred to the coating roller 32 from pickup roller 34. Spot coating assembly 30 is shown in its retracted position in FIG. 1. In this position the assembly is accessible for cleaning, even while the press is running. To this end, a work space is provided adjacent to the coating assembly on a platform 40 on which an operator may stand, to gain access to the spot coating assembly for service and cleaning.

Referring now to FIG. 2, the spot coater 30 is shown in its operating position with coating roller 32 engaging plate cylinder 12. Each of the rollers 32, 34, and 36 of the spot coating assembly 30 is driven by a separate hydraulic motor 42, 44 and 46 respectively. Conventional hydraulic lines 48 convey pressurized hydraulic fluid from a pump and controller valves to the motors and provide for a return to the pump (not shown). The control valves are connected to controller 20. A speed sensor is provided on each of hydraulic motors 42, 44 and 46. The speed sensors are connected to controller 20 via sensing lines 50, 52 and 54. Controller 20 preferably includes conventional displays such as digital for the press speed 60, metering roller speed 62, pickup roller speed 64, and plate coating roller speed 66. The speed of each of the metering, pickup and coating rollers is adjustable by means of controls 68, 70 and 72 respectively that are coupled to the controller valves. In addition, controller 20 is responsive to the press speed as sensed by tachometer 22 for correspondingly increasing or decreasing the speeds of the motors driving pickup, metering and coating rollers, so as to maintain synchronization with the press. It will be understood that synchronization does not necessarily mean that all of the rollers are driven in such a manner as to provide zero slip (relative speed) at the nips, but rather that the desired conditions, which may include relative shear at the nips, are maintained as the press speed is increased. In accordance with a presently preferred embodiment of the invention, the relative speeds of the rollers are set while the press is running at a low speed, and the controller 20 adjusts the speeds of the motors driving the pickup, metering and coating rollers, to maintain the same relative speed as the press speed increases. By adjusting controls 68, 70 and 72, the relative speeds may be fine tuned at any press speed.

As shown in FIG. 2, pickup roller 34 and metering roller 36 are driven directly by hydraulic motors 44 and 46 respectively, while coating roller 32 is driven indirectly by the motor via gear wheels 79, 80, and 81. Those skilled in the art will recognize that the precise manner in which the rollers are driven may be changed to accommodate different arrangements, the particular arrangement shown in FIG. 2 therefore representing only an example of a presently preferred embodiment of the invention.

Frame 38 of spot coating assembly 30 is laterally translatable on horizontally disposed traverse rod 86 rigidly mounted in a support 89, which is attached to coating unit 10. Frame 38 is attached to bearing blocks 92 and 94, that slidably engage rod 86. Linear hydraulic actuator 96 is attached to bracket 97 of frame 38 at one end, and to support 89 at the other, for laterally translating coating assembly 30 into and out of engagement with plate cylinder 12 as illustrated in FIGS. 1 and 2 respectively.

While plate coating assembly 30 is supported on a cantilevered arm of support 89 in accordance with a presently preferred embodiment of this invention, other functionally equivalent arrangements might be useful on printing stages having different configurations from the ones shown.

Figure 3:
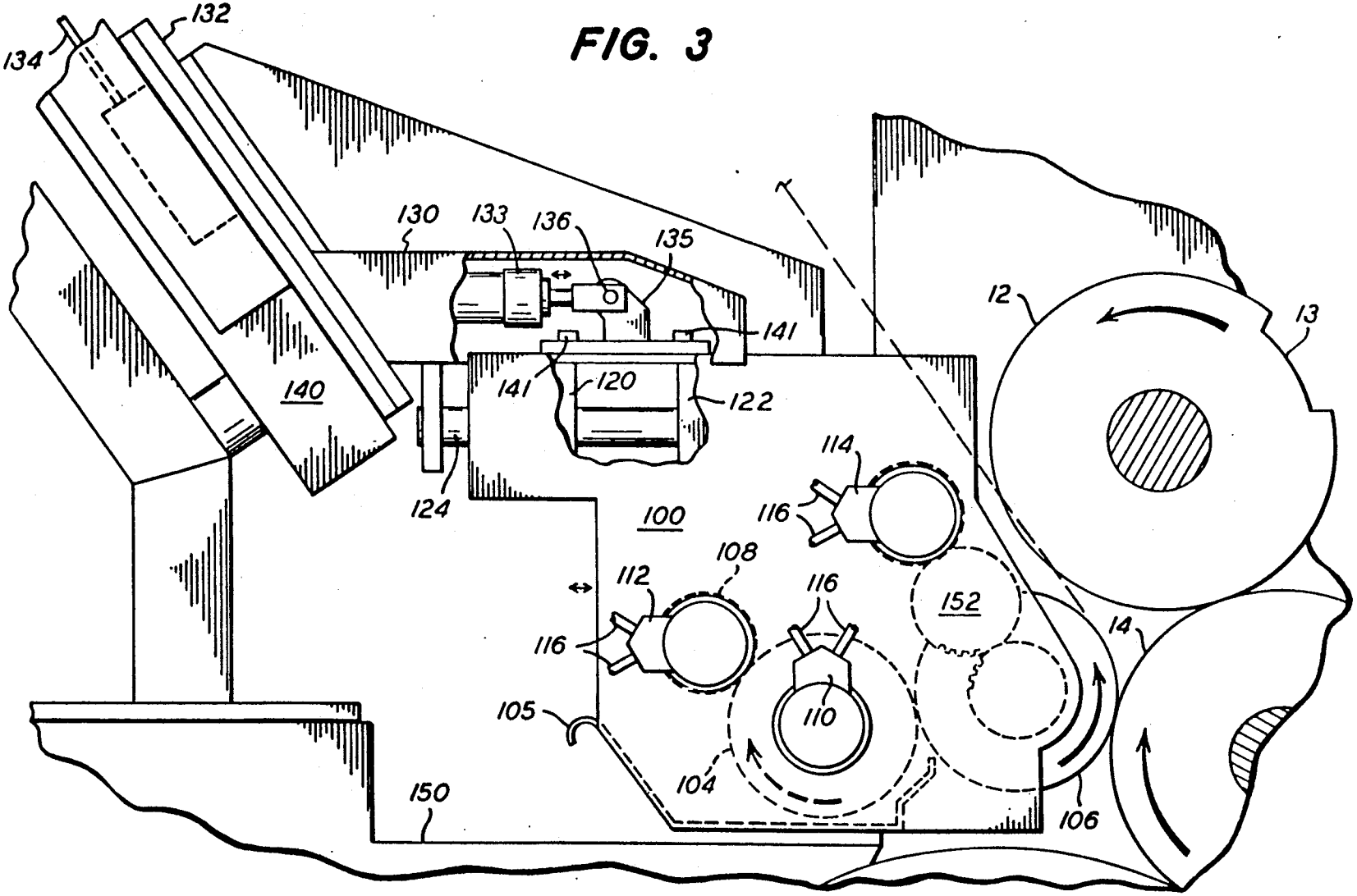
FIG. 3 is a segmental side elevation of the blanket coating assembly of the two headed coater of FIG. 1.

Referring now to FIGS. 1 and 3, the blanket coating assembly 100 of the invention is shown. Like the spot coating assembly, blanket coating assembly 100 includes a pickup roller 104 extending into a tray 105 adapted to contain a supply of coating liquid, such as lacquer or the like. Pickup roller 104 rotates clockwise and transfers the coating liquid onto blanket coating roller 106 in an amount determined by metering roller 108. The pickup, metering and blanket rollers are driven by hydraulic motors 110, 112 and 114 respectively, either directly or via gear wheels in like manner to the plate coater already described. The motors are supplied with pressurized hydraulic fluid through lines 116 in the manner already described in connection with the plate coating assembly 30. Similarly, speed sensors, not shown, are operatively engaged with each of the rollers or the motors to provide feedback signals representing the rotational speed of the rollers.

Blanket coating assembly 100 is carried by bearing blocks 120 and 122 slidably mounted on traverse rod 124, which is rigidly attached to cantilever arm 130 of carriage 132. Linear hydraulic actuator 133 has one end 136 coupled to a bracket 138, which is attached to blanket coating assembly 100 by bolts 141, or in other convenient fashion. Operation of actuator 134 translates plate coating assembly 100 into and out of engagement with blanket cylinder 14. Carriage 132 is attached to lifting cable 134, which extends up track 140 to conventional lifting means (not shown) to permit blanket coating assembly 100 to be raised to the position shown in phantom in FIG. 1, for cleaning or other servicing. Conventional means, such as a linear hydraulic actuator attached to cable 134, are employed to pull carriage 132 to the raised position. It will be appreciated by reference to FIG. 3, that it is necessary to laterally translate assembly 100 to the left before raising the carriage, in order that blanket coating roller 106 will clear the periphery of plate cylinder 12, as the carriage is raised.

When the carriage is raised, space is created on platform 150 for an operator to service blanket coating assembly 100.

It will be understood that a second controller unit similar to controller 20 is provided for controlling the rotation of pickup roller 104, metering roller 108 and coating roller 106. This controller is not shown in the drawings, because the connections thereto would obscure the remaining elements of the invention and are in any event identical to those already shown and described in connection with the plate coater. As was the case in connection with spot coater 30, hydraulic motor 14 drives coating roller 106 through an intermediate gear 152 in conventional fashion.

While the invention has been described in connection with a presently preferred embodiment thereof, those skilled in the art will recognize that certain modifications and changes may be made therein without departing from the true spirit and scope of the invention, which accordingly is intended to be defined solely by the appended claims.

What is claimed is:

1. Coating apparatus for applying continuous or spot coatings to a plate cylinder and a blanket cylinder of a printing press in which the plate cylinder is disposed generally above the blanket cylinder and arranged so that either of a plate coater and a blanket coater can be serviced while the other coater is operating;

a retractable blanket coater disposed on one side of the plate and blanket cylinders for transferring a layer of coating material to the blanket cylinder;

a retractable plate coater disposed on a side of the plate and blanket cylinders opposite the blanket coating roller for applying coating material to said plate cylinder;

blanket coater retracting means for moving said blanket coater between an operating position in contact with said blanket cylinder and a service position out of contact with the blanket cylinder;

plate coater retracting means for moving said plate coater between an operating position in contact with said plate cylinder and a service position out of contact with the plate cylinder; and lifting means for lifting the blanket coater away from the blanket cylinder so that when one of the plate and blanket coaters is operating and the other is out of contact, the out of contact coater may be serviced without interfering with the operation of the operating one of the plate and blanket coaters.

2. The coating apparatus of claim 1 in which the plate coater comprises a plate coating roller and in which the blanket coater comprises a blanket coating roller and a plate coater motor for rotating said plate coating roller; a blanket coater motor for rotating the blanket coating roller; and also comprising speed sensor means for providing a press speed signal; and control means responsive to the press speed signal for controlling the speed of the plate coater motor and the blanket coater motor.

3. The coating apparatus of claim 2 wherein sid speed sensor means comprises tachometer means coupled to one of the plate cylinder and the blanket cylinder.

4. The coating apparatus of claim 2 further comprising a pickup roller for transferring a coating liquid to the plate coating roller and a metering roller for controlling the amount of coating liquid transferred to the plate coating roller.

5. The coating apparatus of claim 4 further comprising motor means for rotating the pickup roller and the metering roller.

6. The coating apparatus of claim 5 wherein said control means is connected to sid motor means for varying the speed of the pickup roller and the metering roller in response to the press speed signal.

7. The coating apparatus of claim 2 further comprising a pickup roller for transferring a coating liquid to the blanket coating roller and a metering roller for controlling the amount of coating liquid transferred to the blanket coating roller.

8. The coating apparatus of claim 7 further comprising motor means for rotating the pickup roller and the metering roller.

9. The coating apparatus of claim 7 wherein said control means is connected to said motor means for varying the speed of the pickup roller and the metering roller in response to the press speed signal.

10. Coating apparatus for a printing press including a plate cylinder and a blanket cylinder, comprising:

a coating assembly including a coating roller engaging one of the plate cylinder and the blanket cylinder, a pickup roller engaging the coating roller, and a metering roller; drive motors coupled to each of the coating roller, the pick up roller and the metering roller; and speed sensor means coupled to a printing press and responsive to the speed of the press and coupled to the drive motors for independently controlling the rotational speeds of at least two of the coating roller, the pickup roller and the metering roller.

11. The coating apparatus of claim 10 in which the speed sensor means comprises a tachometer coupled to the press.

12. The coating apparatus of claim 11 in which the tachometer is coupled to the plate cylinder of the press.

13. The coating apparatus of claim 10 comprising individual speed controllers for each of the drive motors, so that the relative speed at the nip between any two adjacent rollers can be adjusted.

14. The coating apparatus of claim 13 further comprising means for maintaining the relative speeds of the pickup, metering and coating rollers as the press speed varies.

* * * * *